US010604714B2

(12) United States Patent
Lehmann et al.

(10) Patent No.: US 10,604,714 B2
(45) **Date of Patent: *Mar. 31, 2020**

(54) DISPERSING FINES IN HYDROCARBON APPLICATIONS USING ARTIFICIAL LIFT

(71) Applicant: Baker Hughes, a GE company, LLC, Houston, TX (US)

(72) Inventors: Marc N. Lehmann, Perth (AU); Robert C. Hicks, Fortitude Valley (AU); Alison R. Morris, Braeside (AU); Cheryl L. Licari, Perth (AU)

(73) Assignee: Baker Hughes, a GE company, LLC, Houston, TX (US)

( * ) Notice: Subject to any disclaimer, the term of this patent is extended or adjusted under 35 U.S.C. 154(b) by 107 days.

This patent is subject to a terminal disclaimer.

(21) Appl. No.: 15/811,362

(22) Filed: Nov. 13, 2017

(65) Prior Publication Data

US 2018/0066198 A1 Mar. 8, 2018

Related U.S. Application Data

(63) Continuation of application No. 14/558,345, filed on Dec. 2, 2014, now Pat. No. 9,828,560.
(Continued)

(51) Int. Cl.
*C10L 1/32* (2006.01)
*C10L 10/04* (2006.01)
(Continued)

(52) U.S. Cl.
CPC ..... *C10L 1/326* (2013.01); *C10L 10/04* (2013.01); *C10L 10/08* (2013.01); *C10L 10/18* (2013.01);
(Continued)

(58) Field of Classification Search
CPC ..... C10L 1/326; C10L 10/04; C10L 10/08; C10L 10/18; C10L 2290/24; C10L 2270/10; C10L 2230/14; C10L 2290/46
See application file for complete search history.

(56) References Cited

U.S. PATENT DOCUMENTS 4,018,729 A 4/1977 Faucher et al.
4,242,098 A * 12/1980 Braun ..... B65G 53/30 137/13
(Continued)

FOREIGN PATENT DOCUMENTS

AU 2014360552 B2 11/2018
CN 101869811 A 10/2010

OTHER PUBLICATIONS

Klein, S.T., "The Progressing Cavity Pump in Coalbed Methane Extraction", SPE 23454, Oct. 1991 377-387.
(Continued)

*Primary Examiner* — Cephia D Toomer
(74) *Attorney, Agent, or Firm* — Mossman, Kumar & Tyler, P.C.

(57) ABSTRACT

The lifetime of artificial lift systems, such as progressing cavity pumps (PCPs), used to transport aqueous slurries which contain fine particles, e.g. coal fines, may be prolonged by incorporation of at least one dispersant in the slurries. The dispersants act to inhibit or prevent the fine particles from agglomerating to plug the artificial lift intake and/or inhibit or prevent the agglomerated coal fines settling above the artificial lift system. The dispersant may also improve the lubricity of the slurry.

19 Claims, 1 Drawing Sheet

Related U.S. Application Data

(60) Provisional application No. 61/912,876, filed on Dec. 6, 2013.

(51) Int. Cl.
*C10L 10/08* (2006.01)
*C10L 10/18* (2006.01)

(52) U.S. Cl.
CPC ..... *C10L 2230/14* (2013.01); *C10L 2270/10* (2013.01); *C10L 2290/24* (2013.01); *C10L 2290/46* (2013.01)

(56) References Cited

U.S. PATENT DOCUMENTS 4,330,301 A 5/1982 Yamamura et al.
4,432,771 A * 2/1984 Sawyer, Jr. ..... C10L 1/326 406/197
4,441,889 A 4/1984 Mark
4,688,588 A 8/1987 Horsley et al.
9,828,560 B2 * 11/2017 Lehmann ..... C10L 1/326
2010/0248593 A1 9/2010 Sakai et al.

OTHER PUBLICATIONS

Bertero, Luigi, et al., "An Innovative Way to Produce and Transport Heavy Oil Through Dispersion in Water: Laboratory Study and Field Test Results", SPE 28543, Sep. 1994, 283-295.
Zhou, Mingsong, et al., "Properties of Different Molecular Weight Sodium Lignosulfonate Fractions as Dispersant of Coal-Water Slurry", Journal of Dispersion Science and Technology, 27, 2006, 851-856.
Kumar, Ajay, et al., "Productivity enhancement: Pretreatment of coal seams for removal of coal fines from CBM wells during hydro fracturing", 2nd South Asian Geoscience Conf. and Exhibition, GEO India 2011, Paper ID-436, Jan. 2011, 1-7.
Yang, Dong, et al., "Properties fo sodium lignosulfonate as dispersant of coal water slurry", Energy Conversion and Management, 48, 2007, 2433-2438.

* cited by examiner

DISPERSING FINES IN HYDROCARBON APPLICATIONS USING ARTIFICIAL LIFT

CROSS-REFERENCE TO RELATED APPLICATION

This application is a continuation-in-part application of U.S. patent application Ser. No. 14/558,345 filed Dec. 2, 2014, issued as U.S. Pat. No. 9,828,560 on Nov. 28, 2017, which in turn claimed the benefit of U.S. Provisional Application Ser. No. 61/912,876 filed Dec. 6, 2013, both of which are incorporated herein by reference in their entireties.

TECHNICAL FIELD

The invention relates to methods for making aqueous slurries of fine particles and compositions of fine particles so made, and still more particularly relates to methods of improving the life of artificial lift systems (e.g. progressing cavity pumps) that transport aqueous slurries of fine particles, such as coal fines.

TECHNICAL BACKGROUND

Artificial lift refers to the use of artificial means to increase the flow of liquids, such as crude oil or water or slurries containing fine particulates, from a production well or other downhole location. Artificial lift may be achieved by the use of a mechanical device inside the well, such as a pump, or by decreasing the weight of the hydrostatic column by injecting gas into the liquid some distance down the well (e.g. gas lift). Artificial lift is needed in wells when there is insufficient pressure in the reservoir to lift the produced fluids to the surface, but may be used in naturally flowing wells to increase the flow rate above what would flow naturally. Artificial lift systems include hydraulic pumps, electric submersible pumps (ESPs), gas lift systems, PCPs, rod pumps, and the like.

Progressive Cavity Pumps (PCPs) are commonly used positive displacement pumps in the oil and gas industry for artificial lift. These pumps are also known as progressing cavity pumps, eccentric screw pumps or cavity pumps. PCPs transfer fluid by means of the progress through the pump of a sequence of small, fixed shape, discrete cavities as a rotor is turned inside a stator. They are used as a form of artificial lift by operators especially for Coal Seam Gas (CSG) operations. CSG is also known as coal bed methane (CBM), coalbed gas or coal mine methane (CMM). These terms refer to methane absorbed into the solid matrix of coal in subterranean formations. CSG subterranean reservoirs are distinct from typical sandstone or other conventional gas reservoirs, because the methane is stored within the coal by an adsorption process. The methane is in a near-liquid state, lining the inside of pores within the core (the matrix). Open fractures in the coal (termed the cleats) can also contain free gas or can be saturated with water.

Hydraulic fracturing may be used to increase the fractures in a coal matrix to facilitate the production of CSG. However, hydraulic fracturing in a coal bed matrix may cause an increase in the generation of coal fines and debris during the fracturing procedure, particularly due to the fragile nature of the coal. Additionally, coal fines are hydrophobic in nature and tend to cause screen outs in the fracture generation which results in the hydraulic fracture not achieving its desired length. Coal fines are defined herein as having an average particle size of less than 50 microns, although fines may be as large as about 100 to about 200 microns. These coal fines may also not be produced during the flow back of the fracturing fluid, and may consequently reduce the conductivity of the fracture and reduce the production of CSG.

Another consequence of high levels of solids (e.g. coal fines that are displaced by CSG) in the broken fracturing fluid (which has had its viscosity reduced to the same as or near the viscosity of water) and/or produced water during the production of CSG is that the lifetime of the PCPs has been observed to progressively diminish from a life expectancy of about 24 months to approximately 12 months. The primary reasons for premature failure are associated with solids plugging.

More specifically, the three most common causes of premature PCP failure in CSG operations are: (1) overheating caused by solids plugging the intakes resulting in the pump being incompletely filled with fluid, which fluid also lubricates the pump, and thus causing the pump to overheat, (2) high torque loads due to solids settling above the pump, and (3) overheating due to gas intrusion through the pump leading to high temperatures causing the rotor seal elastomer to harden, swell, and crack.

It would be advantageous if methods and compositions could be discovered to prevent fine particulate solids, such as coal fines, from depositing in artificial lift systems, particularly pumps and pump intakes to thereby extend pump lifetimes.

SUMMARY

There is provided, in one non-limiting embodiment, a method of dispersing fine particles in a slurry, where the method includes adding in any order: water, fine particles present in a range of from about 0.001 to about 0.5 wt % based on the total slurry, and at least one dispersant. The at least one dispersant may include, but is not necessarily limited to, poly(ethylene oxide); nonylphenoxy-poly(ethyleneoxy)ethanol; polyethyleneglycol alkyl-(C8-C10)-ethers; partially hydrolyzed poly(acrylamide); hydroxyethyl cellulose (HEC); quaternary nitrogen-substituted cellulose ethers; xanthan gum, hydroxypropyl guar gum, carboxymethyl hydroxypropyl guar gum; petroleum sulfonic acid derivatives, lignin sulfonic acid derivatives, naphthalene sulfonic acid derivatives, salts of these derivatives and formaldehyde condensates of these derivatives; and combinations thereof. The method further comprises mixing the water, coal fines, and at least one dispersant to give a slurry where the coal fines are dispersed therein.

Further in another non-restrictive version, there is provided a method for prolonging the life of an artificial lift system, where the method comprises pumping a fine particle slurry through a PCP, where the fine particle slurry includes water, fine particles (e.g. coal fines) present in a range of from about 0.001 to about 0.5 wt % based on the total slurry, and at least one dispersant (as defined in the previous paragraph), where the life of the artificial lift system is extended, longer or greater as compared with pumping an otherwise identical fine particle slurry having an absence of the at least one dispersant for the same amount of time under the same conditions.

Additionally there is provided in a non-limiting embodiment a slurry having fine particles dispersed therein, which slurry comprises water, fine particles present in a range of from about 0.001 to about 0.5 wt % based on the total slurry, and at least one dispersant. Again, the at least one dispersant may include, but is not necessarily limited to, poly(ethylene oxide); nonylphenoxypoly(ethyleneoxy)ethanol; polyethyleneglycol alkyl-(C8-C10)-ethers; partially hydrolyzed poly (acrylamide); hydroxyethyl cellulose (HEC); quaternary nitrogen-substituted cellulose ethers; xanthan gum, hydroxypropyl guar gum, carboxymethyl hydroxypropyl guar gum; petroleum sulfonic acid derivatives, lignin sulfonic acid derivatives, naphthalene sulfonic acid derivatives, salts of these derivatives and formaldehyde condensates of these derivatives; and combinations thereof.

DETAILED DESCRIPTION

Figure 1:
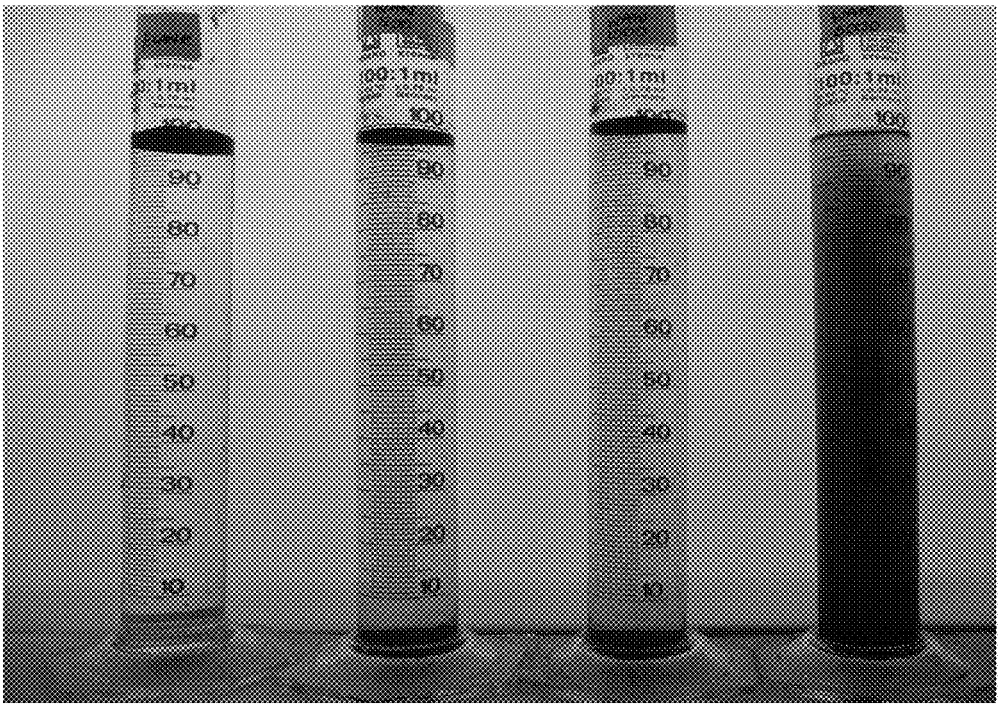
FIG. 1 is a photograph showing, from left to right, the effect of a) no chemical, b) 500 ppm WAW24096 of dispersing agent, c) 1000 ppm of WAW24096 dispersing agent, and d) 5000 ppm of WAW24096 dispersing agent, respectively, on a coal brine slurry.

It has been surprisingly discovered that the use and application of special dispersant chemistries in conjunction with the operation of artificial lift systems such as PCPs may be used to overcome the problem of solids agglomerating and depositing in the PCP pump intakes, and settling in the outlet and well tubing above the PCP. These dispersants work to keep particle size low and prevent the settling and agglomeration of fines which may ultimately lead to artificial lift (e.g. pump) failure and shortened artificial lift (e.g. pump) lifetime.

The dispersancy of coal fines and other particulate hydrocarbons is known to be dependent on the inherent surface chemistry of the coal fines particles, which are inherently hydrophobic, as well as the water pH and the surface zeta potential. The water of the slurry may be a brine, which brine may employ any of the salts commonly used in CSG or other solid or liquid hydrocarbon recovery processes. Similar factors are believed to affect the dispersancy of inorganic fine particulates such as iron sulfides.

A range of chemistries may be used to work as dispersants in the transport of concentrated fines slurries, such as coal slurries, while others have been identified by laboratory testing to be effective in preventing coal fines settling. Potential dispersants that, depending on system conditions, may be used to prevent or inhibit coal fines agglomeration and/or settling include, but are not necessarily limited to, alkyl sulfosuccinates, poly(ethylene oxide); nonylphenoxy-poly(ethyleneoxy)ethanol; polyethyleneglycol alkyl-(C8-C10)-ethers; partially hydrolyzed poly(acrylamide); hydroxyethyl cellulose (HEC); quaternary nitrogen-substituted cellulose ethers; xanthan gum, hydroxypropyl guar gum, carboxymethyl hydroxypropyl guar gum; petroleum sulfonic acid derivatives, lignin sulfonic acid derivatives, naphthalene sulfonic acid derivatives, salts of these derivatives and formaldehyde condensates of these derivatives; and combinations thereof. Suitable quaternary nitrogen-substituted cellulose ethers include those available from Union Carbide as "Polymer JR" as described in U.S. Pat. No. 4,018,729, incorporated herein by reference in its entirety. Suitable xanthan gum, hydroxypropyl guar gum, and carboxymethyl hydroxypropyl guar gum are as described in U.S. Pat. No. 4,242,098, also incorporated herein by reference in its entirety. Suitable alkyl sulfosuccinates include, but are not necessarily limited to, dioctyl sodium sulfosuccinate, sodium 1,4-bis(1,3-dimethylbutyl) sulfonatosuccinate, dicyclohexyl sulfosuccinate sodium salt, and the like and combinations thereof.

In addition, petroleum sulfonic acid derivatives, lignin sulfonic acid derivatives, naphthalene sulfonic acid derivatives, salts of these derivatives and formaldehyde condensates of these derivatives are further described in U.S. Pat. No. 4,330,301 incorporated herein by reference in its entirety as well. These compounds may be prepared by sulfonating naphthalene, alkyl-substituted naphthalene, anthracene, alkyl-substituted anthracene, lignin or petroleum residue having an aromatic ring, according to conventional procedures, subjecting the sulfonation product to a salt-forming reaction if necessary, and conducting condensation with formaldehyde, according to need. At relatively low levels of coal fines in water a formaldehyde condensate of a sulfonation product of naphthalene or a naphthalene derivative having an alkyl group or alkenyl group as the substituent, or a salt thereof, exerts a much higher effect than other polycyclic aromatic compounds, salts thereof, and formaldehyde condensates thereof. As defined herein, the alkyl and alkylene groups have from 1 to 6 carbon atoms.

Further, it is suitable to use naphthalene or a substituted naphthalene containing an alkyl or alkenyl substituent having up to 6 carbon atoms on the average, and mixtures of such naphthalene compounds. For example, formaldehyde condensates of naphthalene sulfonic acid, butylnaphthalene sulfonic acid and mixtures thereof are acceptable. It is also suitable that the degree of condensation is from about 1.2 to about 30, in another non-limiting embodiment from about 1.2 to about 10. If the degree of condensation is lower than 1.2, no substantial improvement of the effect can be attained by the condensation, and if the degree of condensation is higher than 30, the molecular weight is unduly increased and practical problems may arise as regards the water solubility and the like.

Various polycyclic aromatic compounds may be used to form suitable dispersants in the present methods and slurries. Lignin, naphthalene derivatives contained in petroleum residue such as alkylnaphthalene having an alkyl group having 1 to 6 carbon atoms are suitable, and good results may be obtained when these compounds are used. Of course, a mixture of alkyl-substituted derivatives may be used. As the salts, there may be used salts of alkali metals such as sodium and potassium, salts of alkaline earth metals such as calcium, amine salts and ammonium salts of these compounds.

The application of the dispersants into a well may be via a capillary string, via batch treatment, or via slowly dissolving formulations (such as sticks, pills or other solid forms) that are placed into the well tubing or into a well annulus that communicates with the well tubing. It is important that the chemical deployed via these delivery systems commingles with produced water containing the fines prior to entering the pump inlet or chambers, although another practice of this method may be to deliver the dispersant directly into the pump body so as to contain the chemical into production tubing and isolate it from the reservoir. In another non-restrictive variation of the delivery mechanism, the dispersant may be initially placed into the reservoir or near well bore region as part of completion or fracturing fluids. The initial flowbacks during production may contain hydrocarbon fines (such as coal fines, or shale fines) from the fracturing process that become treated with the inherent dispersant and thus so protect the pump from solids build up.

It is expected that the compositions and methods herein would be suitable to form slurries of other fine particulates besides coal fines, including, but not necessarily limited to, shale fines, clay fines, and inorganic solids such as iron sulfides, and the like. The fine particles or fines may have an average particle size of less than about 200 microns, alternatively less than about 100 microns, and in another non-limiting embodiment the average particle size is less than 50 microns.

The amount of the at least one dispersant in the slurry should be sufficient to inhibit or prevent the coal fines (or other fine particulates) from agglomerating as compared to an otherwise identical method absent the at least one dispersant. While it is certainly desired that coal fines (or other fine particulates) are completely prevented from agglomerating and/or settling, and in a particular instance that the life of a PCP (or other artificial lift) is not adversely affected by coal fines at all, the methods and compositions herein are considered successful if the at least one dispersant is sufficient, or present in an effective amount, to inhibit or prevent the coal fines from agglomerating as compared to an otherwise identical method absent the at least one dispersant. In one non-limiting embodiment, the life of the PCP is extended, longer or greater as compared with pumping an otherwise identical coal fines slurry having an absence of the at least one dispersant for the same amount of time under the same conditions.

As noted, a number of factors affect the effective amount of the at least one dispersant in the slurry, including, but not necessarily limited to, the inherent surface chemistry of the coal fines or other particulates, the pH of the water (or brine) and the surface zeta potential of the particles. The pH of the brine may range from about 4 independently to about 10; alternatively from about 6 independently to about 7. In US CSG processes the pH may range from about 4 to about 7, while in Australia and New Zealand the pH may range from about 6 to about 10. In one non-restrictive version, the amount of the at least one dispersant ranges from about 50 independently to about 10,000 ppm, based on the total slurry; alternatively from about 100 independently to about 2000 ppm. As used herein with respect to a range, the term "independently" means that any lower threshold may be combined with any upper threshold to form a suitable alternative range.

In one non-limiting embodiment, the amount of fine particles, e.g. coal fines, (loading) based on the total slurry may ranges from about 0.001 independently to about 0.5 wt %, alternatively from about 0.01 independently to about 0.1 wt %. In one alternative non-limiting embodiment, the slurry has an absence of a wetting agent.

The invention will be described further in the following illustrative Examples, which are non-limiting and serve only to further illuminate the compositions and methods described herein.

EXAMPLE 1

Coal from Victoria, Australia, was ground and sieved to a particle range of less than 100 micron. Coal was suspended into a brine comprised of the following composition shown in Table I:

TABLE I

| Brine Composition | |
|---|---|
| Brine Component | Level |
| Sodium chloride | 3500 mg/L |
| Sodium bicarbonate | 1200 mg/L |
| pH | 8.5 |
| Coal fines (<100 micron) | 0.5 wt. % |

The effect of a variety of dispersants and concentrations was measured by a) evaluating the setting rate of the coal fines in 100 ml measuring cylinders, and b) measuring the time dependent transmission of the brines at 485 nm, in the presence and absence of dispersants. The results are shown in FIG. 1. The dispersant used was WAW24096 dispersant, which is a proprietary mixture of wetting/dispersing agents available from Baker Hughes Incorporated that includes sodium bis(2-ethylhexyl) sulfosuccinate as a dispersant.

The results are shown in FIG. 1, which is a photograph showing (from left to right) the effect of a) no chemical, and respectively b) 500 ppm of WAW24096 dispersant, c) 1000 ppm of WAW24096 dispersant and d) 5000 ppm of WAW24096 dispersant. It may be readily seen that the greatest dispersant effect in the brine was with d) 5000 ppm of WAW24096 dispersant.

EXAMPLE 2

Figure 2:
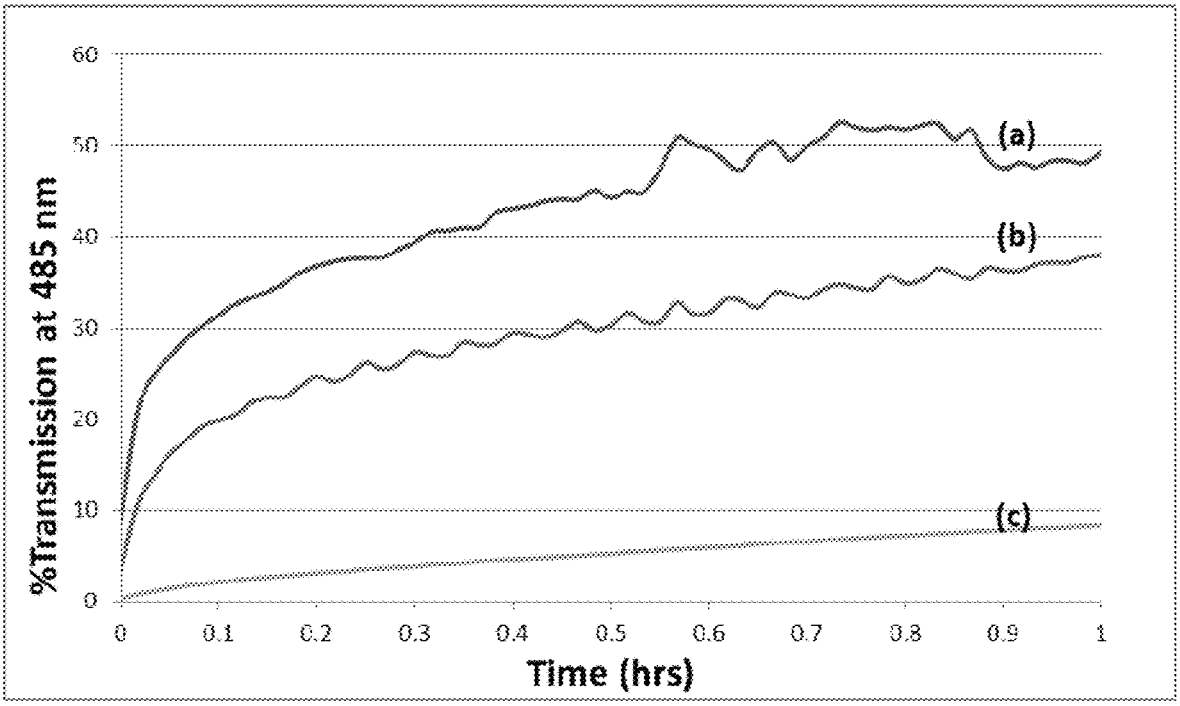
FIG. 2 is a graph showing the time dependent transmission of coal fines in the (a) absence of chemical, (b) treatment with 5000 ppm of sodium bis(2-ethylhexyl) sulfosuccinate, (c) treatment with 250 ppm sodium bis(2-ethylhexyl) sulfosuccinate and 250 ppm sodium salt of sulphonated naphthalene formaldehyde condensate.

FIG. 2 shows the time dependent transmission at 485 nm of coal fines in the (a) absence of chemical, (b) treatment with 5000 ppm of sodium bis(2-ethyl-hexyl) sulfosuccinate, and (c) treatment with 250 ppm sodium bis(2-ethylhexyl) sulfosuccinate and 250 ppm sodium salt of sulphonated naphthalene formaldehyde condensate. The coal fines and brine used in Example 2 were the same as those used in Example 1.

The transmission is inversely proportional to level of coal fines dispersed in the brine. As can be seen in FIG. 2 in the absence of a dispersant or dispersant mix, the coal fines readily settle or agglomerate and float, consequently clearing the brine to afford greater transmission. More specifically, the treated samples (b) and (c) dispersed the coal fines.

Many modifications may be made in the present invention without departing from the spirit and scope thereof that are defined only by the appended claims. For example, certain components per se, or combinations of components thereof other than those specifically set out herein may be found by one of routine skill in the art to be particularly advantageous, e.g. different combinations of water or different brines with coal fines or other different particulates and different dispersants, other than those mentioned or exemplified are expected to be useful.

The words "comprising" and "comprises" as used throughout the claims is interpreted "including but not limited to".

The present invention may suitably comprise, consist or consist essentially of the elements disclosed and may be practiced in the absence of an element not disclosed. For instance, in one non-limiting embodiment, the slurry having fine particles dispersed therein may consist essentially of or consist of water, fine particles present in a range of from about 0.001 to about 0.5 wt % based on the total slurry, and at least one dispersant, where the at least one dispersant may include, but is not necessarily limited to, alkyl sulfosuccinates, poly(ethylene oxide); nonylphenoxypoly(ethyleneoxy)ethanol; polyethyleneglycol alkyl-(C8-C10)-ethers;

partially hydrolyzed poly(acrylamide); hydroxyethyl cellulose (HEC); quaternary nitrogen-substituted cellulose ethers; xanthan gum, hydroxypropyl guar gum, carboxymethyl hydroxypropyl guar gum; petroleum sulfonic acid derivatives, lignin sulfonic acid derivatives, naphthalene sulfonic acid derivatives, salts of these derivatives and formaldehyde condensates of these derivatives; and combinations thereof.

There is additionally provided in another non-restrictive version, a method for prolonging the life of an artificial lift system, where the method consists essentially of or consists of pumping a fine particle slurry through a progressive cavity pump, where the fine particle slurry comprises, consists essentially of, or consists of water, fine particles present in a range of from about 0.001 to about 0.5 wt % based on the total slurry, and at least one dispersant, where the at least one dispersant may include, but is not necessarily limited to, alkyl sulfosuccinates, poly(ethylene oxide); nonylphenoxypoly(ethyleneoxy)ethanol; polyethyleneglycol alkyl-(C8-C10)-ethers; partially hydrolyzed poly(acrylamide); hydroxyethyl cellulose (HEC); quaternary nitrogen-substituted cellulose ethers; xanthan gum, hydroxypropyl guar gum, carboxymethyl hydroxypropyl guar gum; petroleum sulfonic acid derivatives, lignin sulfonic acid derivatives, naphthalene sulfonic acid derivatives, salts of these derivatives and formaldehyde condensates of these derivatives; and combinations thereof, where the life of the artificial lift system is extended as compared with pumping an otherwise identical fine particle slurry having an absence of the at least one dispersant for the same amount of time under the same conditions.

What is claimed is:

1. A method comprising:

dispersing fine particles in a slurry, the dispersing comprising:

adding in any order:

brine;

fine particles present in a range of from about 0.001 to about 0.5 wt % based on the total slurry; and at least one dispersant;

mixing the brine, fine particles and at least one dispersant to give a slurry where the fine particles are dispersed therein; and transporting the slurry.

2. The method of claim 1 where the at least one dispersant selected from the group consisting of:

alkyl sulfosuccinates;

poly(ethylene oxide);

nonylphenoxypoly(ethyleneoxy)ethanol;

polyethyleneglycol alkyl-(C8-C10)-ethers;

partially hydrolyzed poly(acrylamide);

hydroxyethyl cellulose (HEC);

quaternary nitrogen-substituted cellulose ethers;

xanthan gum, hydroxypropyl guar gum, carboxymethyl hydroxypropyl guar gum;

petroleum sulfonic acid derivatives, lignin sulfonic acid derivatives, naphthalene sulfonic acid derivatives, salts of these derivatives and formaldehyde condensates of these derivatives; and combinations thereof.

3. The method of claim 1 where the amount of the at least one dispersant is sufficient to inhibit or prevent the fine particles from agglomerating as compared to an otherwise identical method absent the at least one dispersant.

4. The method of claim 1 where the amount of the at least one dispersant ranges from about 50 to about 10,000 ppm, based on the total slurry.

5. The method of claim 1 where the brine has a pH ranging from about 4 to about 10.

6. The method of claim 1 where the fine particles have an average particle size of less than 50 microns.

7. The method of claim 6 where the fine particles are selected from the group consisting of coal fines, shale fines, clay fines, iron sulfides, and combinations thereof.

8. The method of claim 1 where the slurry has an absence of a wetting agent.

9. A method for prolonging the life of an artificial lift system, where the method comprises:

pumping a fine particle slurry through an artificial lift system, where the fine particle slurry comprises:

water;

fine particles present in a range of from about 0.001 to about 0.5 wt % based on the total slurry; and at least one dispersant;

where the life of the artificial lift system is prolonged as compared with pumping an otherwise identical fine particle slurry having an absence of the at least one dispersant for the same amount of time under the same conditions.

10. The method of claim 9 where the at least one dispersant is selected from the group consisting of:

alkyl sulfosuccinates;

poly(ethylene oxide);

nonylphenoxypoly(ethyleneoxy)ethanol;

polyethyleneglycol alkyl-(C8-C10)-ethers;

partially hydrolyzed poly(acrylamide);

hydroxyethyl cellulose (HEC);

quaternary nitrogen-substituted cellulose ethers;

xanthan gum, hydroxypropyl guar gum, carboxymethyl hydroxypropyl guar gum;

petroleum sulfonic acid derivatives, lignin sulfonic acid derivatives, naphthalene sulfonic acid derivatives, salts of these derivatives and formaldehyde condensates of these derivatives; and combinations thereof.

11. The method of claim 9 where the amount of the at least one dispersant is sufficient to inhibit or prevent a problem selected from the group consisting of the fines agglomerating, the fines settling, and both, as compared to an otherwise identical method absent the at least one dispersant.

12. The method of claim 9 where in the slurry the amount of the at least one dispersant ranges from about 50 to about 10,000 ppm, based on the total slurry.

13. The method of claim 9 where in the fine particle slurry the water is brine.

14. The method of claim 13 where in the slurry the brine has a pH ranging from about 4 to about 10.

15. The method of claim 9 where in the slurry where the fine particles have an average particle size of less than 50 microns.

16. The method of claim 15 where the fine particles are selected from the group consisting of coal fines, shale fines, clay fines, iron sulfides, and combinations thereof.

17. The method of claim 9 where the slurry has an absence of a wetting agent.

18. The method of claim 9 where the artificial lift system is selected from the group consisting of hydraulic pumps, rod pumps, electrical submersible pumps, progressing cavity pumps, jet pumps, plunger lift, gas lift, and combinations thereof.

19. The method of claim 9 further comprising pumping the slurry in a process selected from the group consisting of a coal seam gas (CSG) operation and a solid or liquid hydrocarbon recovery process.

* * * * *